US009273500B2

(12) United States Patent
Fan

(10) Patent No.: US 9,273,500 B2
(45) Date of Patent: Mar. 1, 2016

(54) RACK-STOP STRUCTURE FOR DOOR

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventor: Yong-Chang Fan, Wuhan (CN)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 34 days.

(21) Appl. No.: 14/062,895

(22) Filed: Oct. 25, 2013

(65) Prior Publication Data

US 2014/0182081 A1 Jul. 3, 2014

(30) Foreign Application Priority Data

Dec. 29, 2012 (CN) ..... 2012 1 0588976

(51) Int. Cl.

| | |
|---|---|
| ***E05C 17/04*** | (2006.01) |
| ***E05C 17/28*** | (2006.01) |
| ***E05C 17/22*** | (2006.01) |
| ***E05C 17/26*** | (2006.01) |
| ***E05C 17/08*** | (2006.01) |
| *E05C 17/18* | (2006.01) |

(52) U.S. Cl.

CPC ..... *E05C 17/28* (2013.01); *E05C 17/085* (2013.01); *E05C 17/22* (2013.01); *E05C 17/26* (2013.01); *Y10T 16/61* (2015.01)

(58) Field of Classification Search

CPC ..... E05C 17/00; E05C 17/12; E05C 17/20; E05C 17/22; E05C 17/26; E05C 17/28

USPC ..... 292/262, 265, 270, 338, 339, DIG. 11, 292/DIG. 14, DIG. 15; 16/82; 49/394, 395

See application file for complete search history.

(56) References Cited

U.S. PATENT DOCUMENTS

| | | | | | |
|---|---|---|---|---|---|
| 600,718 | A | * | 3/1898 | Goodell | 292/13 |
| 851,193 | A | * | 4/1907 | Younglove | 292/270 |
| 1,565,713 | A | * | 12/1925 | Christiansen | 292/265 |
| 1,775,116 | A | * | 9/1930 | Bertrand | 292/268 |
| 1,796,331 | A | * | 3/1931 | Jackson et al. | 217/60 C |

(Continued)

FOREIGN PATENT DOCUMENTS

| | | |
|---|---|---|
| CH | 173656 | * 12/1934 |
| CH | 373278 | * 11/1963 |

(Continued)

*Primary Examiner* — Carlos Lugo

(74) *Attorney, Agent, or Firm* — Novak Druce Connolly Bove + Quigg LLP

(57) ABSTRACT

A rack-stop structure of a frame and a door includes a bracket, a bar, and a pull spring. A positioning slideway and an escaping slideway are defined in the bracket. A plurality of positioning portions and a plurality of escaping tabs are located on the positioning slideway. Each of the plurality of positioning portions is spaced by each of the plurality of escaping tabs. An engaging cutout is defined in each of the plurality of positioning portions. One end of the bar is slidable in the bracket. A pin is located at the end of the bar. The pull spring is mounted to the bar for pulling the bar away from the bracket.

19 Claims, 6 Drawing Sheets

(56) References Cited

U.S. PATENT DOCUMENTS

| | | | | | |
|---|---|---|---|---|---|
| 1,986,307 | A | * | 1/1935 | Wagner | 217/60 C |
| 2,470,706 | A | * | 5/1949 | Larson | 292/108 |
| 2,551,415 | A | * | 5/1951 | Calling | 217/60 C |
| 3,369,833 | A | * | 2/1968 | Schaldenbrand | 292/268 |
| 3,512,820 | A | * | 5/1970 | Barroero | 292/270 |
| 4,524,496 | A | * | 6/1985 | Tehsildar et al. | 27/18 |
| 4,663,801 | A | * | 5/1987 | Malopolski, Jr. | 16/82 |
| 4,751,766 | A | * | 6/1988 | Fahs et al. | 16/332 |
| 4,925,223 | A | * | 5/1990 | Craft | 292/339 |
| 5,570,493 | A | * | 11/1996 | Gulick | 27/18 |
| 6,932,396 | B2 | * | 8/2005 | Masseth et al. | 292/338 |
| 7,377,561 | B2 | * | 5/2008 | Shin | 292/262 |
| 8,480,141 | B2 | * | 7/2013 | Lee | 292/338 |

FOREIGN PATENT DOCUMENTS

| | | | | | |
|---|---|---|---|---|---|
| DE | 1037918 | | * | 8/1958 | |
| EP | 962614 | | * | 12/1999 | |
| EP | 1020598 | A2 | * | 7/2000 | E05C 17/48 |
| FR | 499004 | | * | 1/1920 | |
| FR | 2044568 | | * | 2/1971 | |
| FR | 2693758 | A1 | * | 1/1994 | E05C 17/12 |
| GB | 351066 | | * | 10/1931 | |
| GB | 355396 | | * | 10/1931 | |
| GB | 2131077 | A | * | 6/1984 | E05C 17/04 |
| GB | 2225377 | A | * | 5/1990 | E05C 17/34 |

* cited by examiner

RACK-STOP STRUCTURE FOR DOOR

BACKGROUND

1. Technical Field

The disclosure generally relates to rack-stop structures, especially for a gear stop structure for a door or window.

2. Description of Related Art

A traditional stop structure includes friction tabs to support a door or a window at an open state. The friction tabs are mounted to the door or window and a frame, and are rotatable relative to each other. When the door or window is opened, the friction tabs rotate relative to each other. The door or window can be stopped at a desired angle by friction force between the friction tabs. However, after many uses, the friction force can disappear. There is a room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
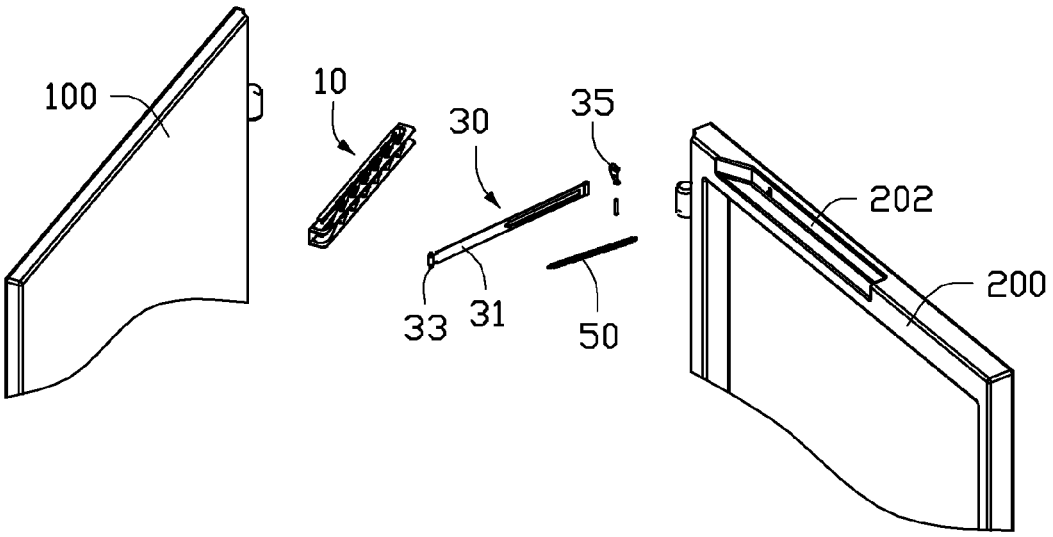
FIG. 1 is an exploded, isometric, and cutaway view of a rack-stop structure of one embodiment.

FIG. 1 illustrates one embodiment of a rack-stop structure for adjusting an angle between a door 100 and a frame 200. The door 100 is pivotable about the frame 200. A recess 202 is defined in the frame 200 to receive the rack-stop structure.

The rack-stop structure includes a bracket 10, a bar 30, and a pull spring 50.

The bar 30 includes a rod 31, a pin 33, and a fixing tab 35. The fixing tab 35 is mounted to a first end of the rod 31 and the fixing tab 35 is rotatable relative to the rod 31. The pin 33 protrudes out from a second end of the rod 31. The second end of the rod 31 is slideable on the bracket 10.

Figure 2:
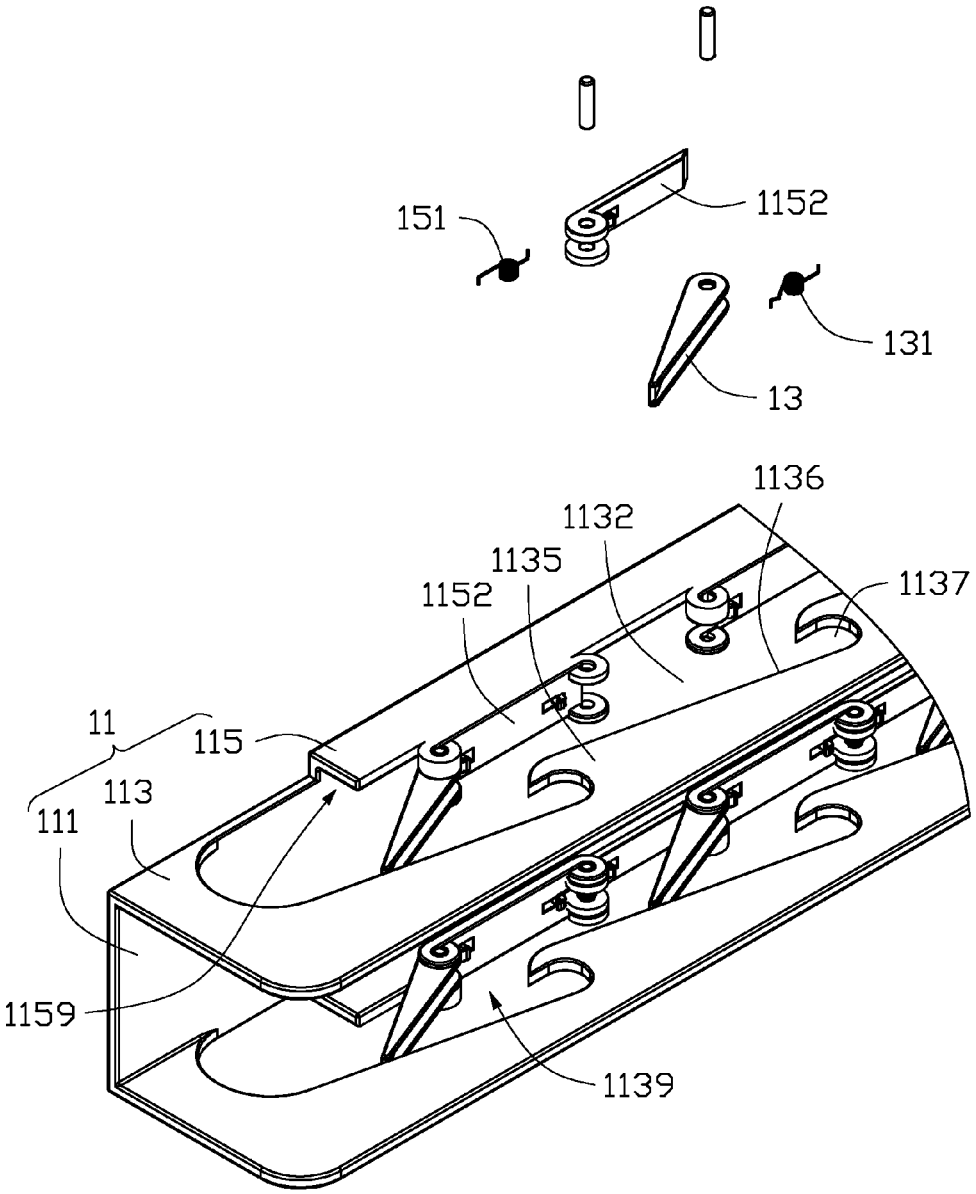
FIG. 2 is a partially exploded, cutaway view of a bracket of the rack-stop structure of FIG. 1.

FIG. 2 illustrates a partial isometric view of the rack-stop structure. The bracket 10 includes a body 11, a plurality of escaping tabs 13, and a plurality of flaps 1152. The body 11 includes a sidewall 111, two positioning walls 113, and a pair of escaping rails 115. The two positioning walls 113 are substantially parallel to each other and are substantially perpendicular to the sidewall 111. The body 11 is substantially U-shaped. A positioning slideway 1139 and an escaping slideway 1159 are defined in the body 11. Two opposite ends of the escaping slideway 1159 communicate with two opposite ends of the positioning slideway 1139. The positioning slideway 1139 includes two positioning slots 1132. Each of the two positioning slots 1132 are defined in each of the two positioning walls 113. The escaping slideway 1159 is defined between the pair of escaping rails 115. A cross-section of each of the pair of the escaping rails 115 is substantially L-shaped. Each of the two positioning walls 113 includes a plurality of position portions 1135. A connecting surface 1136 is defined in each side of plurality of position portions 1135, and a plurality of engaging cutouts 1137 is defined in each of the plurality of position portions 1135. Each connecting surface 1136 is substantially slanted relative to a first direction. The plurality of engaging cutouts 1137 can restrict the pin 33 from moving along the first direction. The plurality of flaps 1152 is located on one side of the escaping slideway 1159. The plurality of flaps 1152 can be biased away from the escaping slideway 1159. The plurality of escaping tabs 13 is located in each positioning slot 1132. The plurality of positioning portions 1135 is spaced by each of the plurality of escaping tabs 13. Each of the plurality of escaping tabs 13 is pivoted to each escaping rail 115. A free end of each of the plurality of the escaping tabs 13 abuts each connecting surface 1136. A first coil spring 131 is located on each escaping tab 13. A second coil spring 151 is located on each flap 1152.

Figure 3:
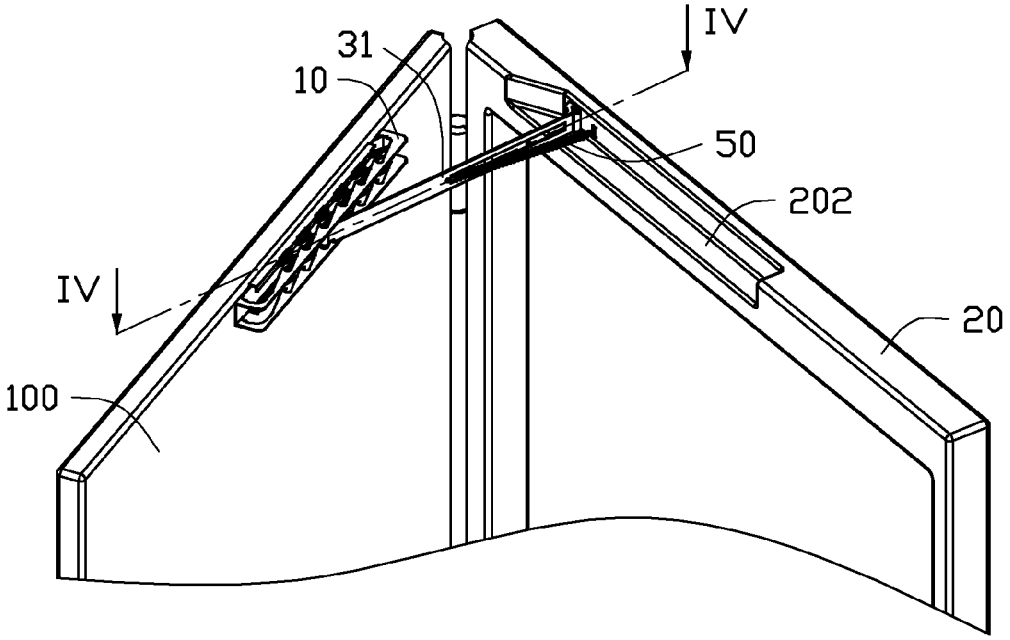
FIG. 3 is an assembled view of the rack-stop structure of FIG. 1 shown in one state.
Figure 4:
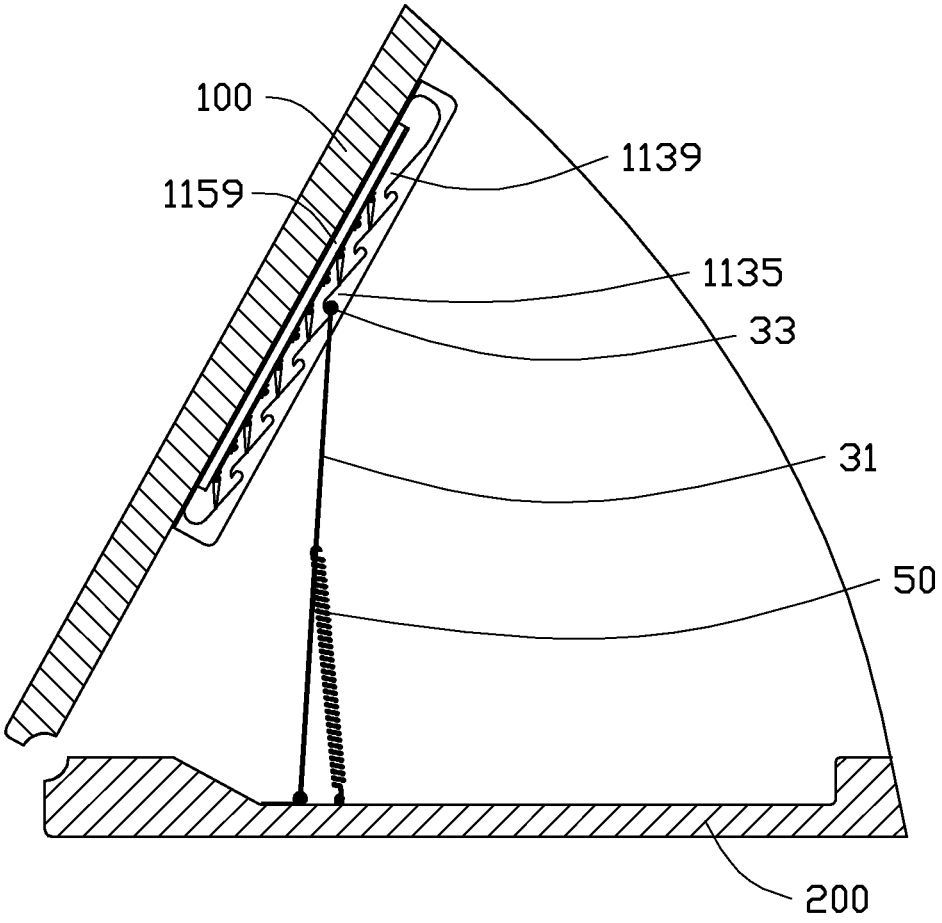
FIG. 4 is a cross-sectional view of the rack-stop structure of FIG. 3.

FIG. 3 and FIG. 4 are two assembled views of the door 100, the frame 200, and the rack-stop structure. In assembly, the door 100 is rotatable relative to the frame 200. The bracket 11 is mounted to the door 100. The first end of the rod 31 is mounted to the frame 200. The pull spring 50 is mounted to the rod 31 and the frame 200 to pull the bar 30 away from the bracket 10. The pin 33 is engaged in the positioning slideway 1139 between the two positioning walls 113.

Figure 5:
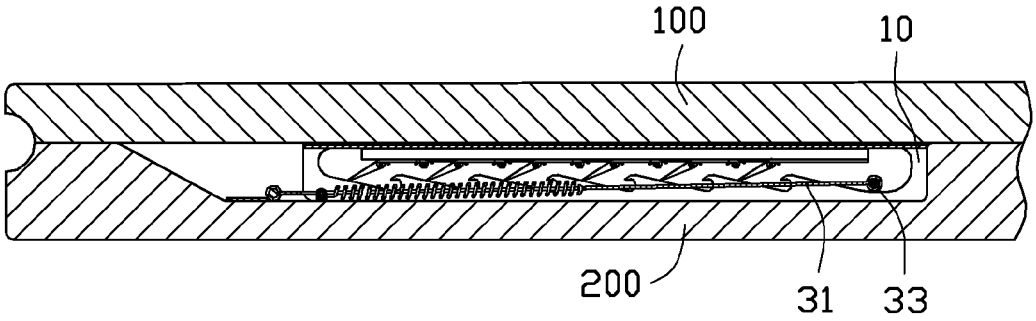
FIG. 5 is similar to FIG. 4, but shown in a folded state.
Figure 6:
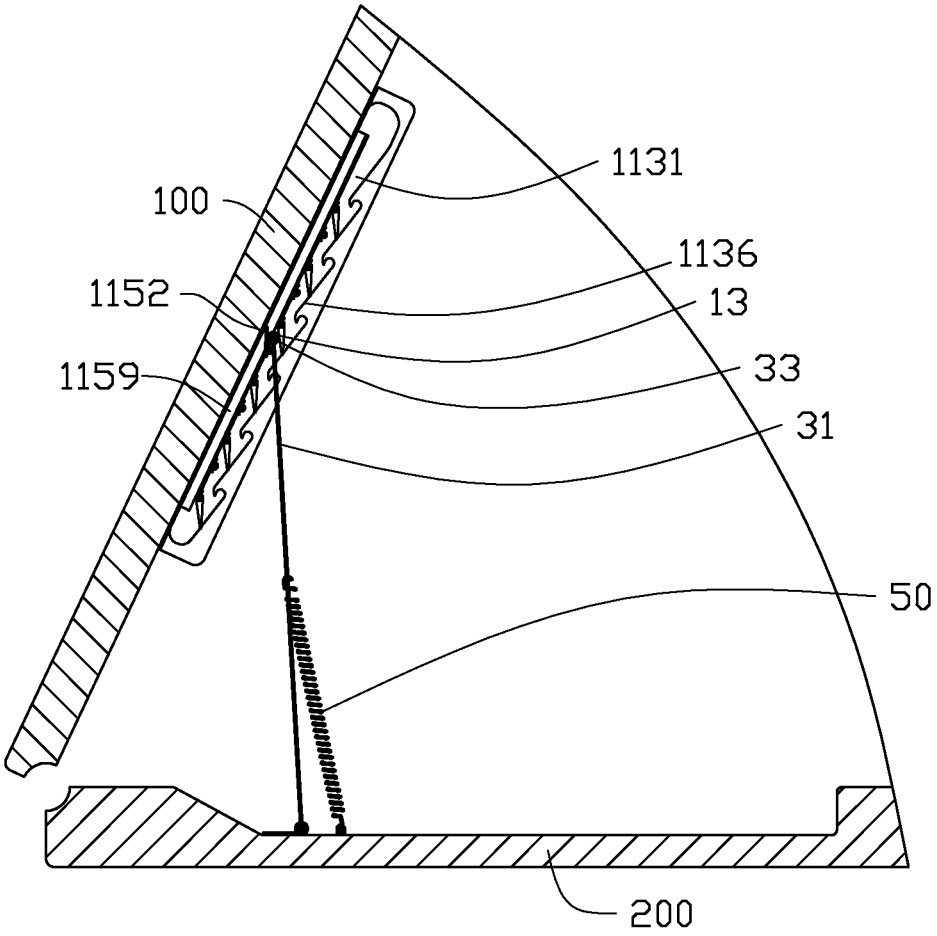
FIG. 6 is similar to FIG. 5, but a pin is moved to an escaping slideway from a positioning slideway.

FIG. 5 illustrates a cross-section of the rack-stop structure in a folded state, and FIG. 6 is similar to FIG. 5, but in an unfolded state. In the folded state, the door 100 is folded relative to the frame 200, and the pin 33 is located on an end of the slideway 1139. When the door 100 is opened relative to the frame 200, the pin 33 slides on each connecting surface 1136 substantially along a second direction. The second direction is substantially opposite to the first direction. The pin 33 can go over the positioning portion 1135 and the escaping tab 13 in the positioning slideway 1139. The escaping tab 13 can resiliently rotate away from the connecting surface 1136 urged by the pin 33. When the door 100 stops rotating relative to the frame 200, the pin 33 moves back under a pulling force of the pull spring 50. If the pin 33 meets the engaging recess 1137, the pin 33 engages with the engaging recess 1137 along the first direction. If the pin 33 meets the escaping tab 13, the pin 33 moves to the escaping slideway 1159 from the positioning slideway 1139 through the plurality of the escaping tabs 13 along the first direction, and the flap 1152 is biased by the pin 33. Thus, the door 100 can be stopped at predefined angles when the pin 33 is engaged with one of the plurality of engaging recesses 1137, and the door 100 can move back to the unfolded state when the pin 33 moves to the escaping slideway 1159.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and arrangement of parts within the principles of the disclosure to the full extent indicated by the broad general meaning of the terms in which the appended claims are expressed.

What is claimed is:

1. A rack-stop structure for a frame and a door, comprising:

a bracket mounted to the door and defining a positioning slideway and an escaping slideway;

a bar mounted to the frame and having one end slidable in the positioning slideway and the escaping slideway of the bracket;

a pin located at the end of the bar; and a pull spring mounted to the bar for pulling the bar away from the bracket, wherein the bracket comprises a plurality of positioning portions and a plurality of escaping tabs located on the positioning slideway; each of the plurality of positioning portions is spaced by each of the plurality of escaping tabs; an engaging cutout is defined in each of the plurality of positioning portions, the pin is movable from an engaged state to an escaped state; when the pin is in the engaged state, the bar is unfolded relative to the bracket at a fixed angle, and the pin is engaged with one of the engaging cutouts along a first direction; when the pin is in the escaped state, the pin is movable to the escaping slideway from the positioning slideway through one of the plurality of the escaping tabs along the first direction, and the bar is movable to be folded relative to the bracket, wherein the bracket further comprises a plurality of flaps, each of the plurality of flaps is configured to prevent the pin from moving from the escaping slideway back to the positioning slideway.

2. The rack-stop structure of claim 1, wherein each of the plurality of flaps, is configured to be biased from the positioning slideway to the escaping slideway.

3. The rack-stop structure of claim 1, wherein a connecting surface is defined in one side of each of the positioning portions and extends to each of the plurality of engaging cutouts, and the connecting surface is slanted relative to the first direction.

4. The rack-stop structure of claim 3, wherein a free end of each of the plurality of the escaping tab abuts the connecting surface, when the pin moves on the connecting surface along a second direction, the escaping tab is configured to resiliently rotate away from the connecting surface urged by the pin, and the second direction is substantially opposite to the first direction.

5. The rack-stop structure of claim 1, wherein an extending direction of the escaping slideway is substantially parallel to an extending direction of the positioning slideway, and an end of the escaping slideway communicates with an end of the positioning slideway.

6. The rack-stop structure of claim 1, wherein the bracket comprises a body, the body is substantially U-shaped, and the escaping slideway and the positioning slideway are defined in the body.

7. The rack-stop structure of claim 6, wherein the body comprises a sidewall and Two positioning walls, the two positioning walls are substantially parallel to each other and are substantially perpendicular to the sidewall, a positioning slot is defined in each of the two positioning walls, and the positioning slideway comprises the two positioning slots.

8. The rack-stop structure of claim 6, wherein the body comprises a pair of escaping rails, the escaping slideway is defined between the pair of escaping rails, and a cross-section of each of the pair of the escaping rails is substantially L-shaped.

9. The rack-stop structure of claim 8, wherein the bar includes a rod, and two opposite ends of the pin protrudes from the rod to engage with the plurality of engaging cutouts.

10. A rack-stop structure for a frame and a door, comprising:

a bracket mounted to the door and defining a positioning slideway;

a bar mounted to the frame and having one end slidable in the positioning slideway of the bracket;

a pin located at the end of the bar; and a pull spring mounted to the bar for pulling the bar to abut against the bracket, wherein the bracket comprises a plurality of positioning portions and a plurality of escaping tabs located on the positioning slideway; each of the plurality of positioning portions is spaced by each of the plurality of escaping tabs; an engaging cutout is definedin each of the plurality of positioning portions; a connecting surface is defined in one side of each of the positioning portions and extends to each of the plurality of engaging cutouts; the pin is configured to engage with a first engaging cutout of the plurality of engaging cutouts along a first direction; the pin is configured to move along the connecting surface and a second direction from the first engaging cutout of the plurality of engaging cutouts to a second engaging cutout of the plurality of engaging cutouts; the second direction is substantially opposite to the first direction; and the plurality of escaping tabs prevent the pin from moving back to the first cutout along the first direction on the connecting surface when the pin goes over each of the plurality of escaping tabs.

11. The rack-stop structure of claim 10, wherein an escaping slideway is defined in the bracket, and the pin is movable to the escaping slideway from the positioning slideway through one of the plurality of the escaping tabs along the first direction.

12. The rack-stop structure of claim 10, wherein the connecting surface is slanted relative to the first direction.

13. The rack-stop structure of claim 12, wherein a free end of each of the plurality of the escaping tabs abuts the connecting surface, when the pin moves on the connecting surface along the second direction, the escaping tab is configured to resiliently rotate away from the connecting surface urged by the pin.

14. The rack-stop structure of claim 10, wherein the bracket further comprises a plurality of flaps, is configured to be biased from the positioning slideway to the escaping slideway.

15. The rack-stop structure of claim 14, wherein an extending direction of the escaping slideway is substantially parallel to an extending direction of the positioning slideway, and an end of the escaping slideway communicates with an end of the positioning slideway.

16. The rack-stop structure of claim 15, wherein the bracket comprises a body, the body is substantially U-shaped, and the escaping slideway and the positioning slideway are defined in the body.

17. The rack-stop structure of claim 16, wherein the body comprises a sidewall and two positioning walls, the two positioning walls are substantially parallel to each other and are substantially perpendicular to the sidewall, a positioning slot is defined in each of the two positioning walls.

18. The rack-stop structure of claim 16, wherein the body comprises a pair of escaping rails, the escaping slideway is defined between the pair of escaping rails, and a cross-section of each of the pair of the escaping rails is substantially L-shaped.

19. The rack-stop structure of claim 18, wherein the bar includes a rod, and two opposite ends of the pin protrudes from the rod to engage with the plurality of engaging cutouts.

* * * * *